United States Patent [19]

Mahaney

[11] 4,351,291

[45] Sep. 28, 1982

[54] GLOW PLUG

[75] Inventor: Robert A. Mahaney, Graytown, Ohio

[73] Assignee: Champion Spark Plug Company, Toledo, Ohio

[21] Appl. No.: 193,377

[22] Filed: Oct. 2, 1980

[51] Int. Cl.[3] ..... H05B 3/00; F23Q 7/00

[52] U.S. Cl. ..... 123/145 A; 123/145 R; 361/264; 219/267

[58] Field of Search ..... 123/143 A, 145 R, 145 A; 361/264, 266; 219/267, 270

[56] References Cited

U.S. PATENT DOCUMENTS

| | | | |
|---|---|---|---|
| 2,492,755 | 12/1949 | McCollum | 219/267 |
| 2,884,920 | 5/1959 | Moule et al. | 123/145 A |
| 3,252,122 | 5/1966 | Baxter | 123/145 R |
| 3,749,980 | 7/1973 | Baxter | 219/267 |
| 4,200,077 | 4/1980 | Kanhl et al. | 361/266 |
| 4,281,451 | 8/1981 | Mann | 123/145 A |

*Primary Examiner*—Raymond A. Nelli

*Attorney, Agent, or Firm*—John C. Purdue; Oliver E. Todd, Jr.

[57] ABSTRACT

A glow plug for accelerating the ignition of fuel in a combustion chamber of a diesel engine is disclosed. The glow plug comprises a shell releasably engagable with a head of a combustion chamber of the diesel engine, and an electrically conducting, tubular heater carried by and electrically connected to the shell. The heater has an open end within the shell, and an opposed closed end extending longitudinally therefrom. The glow plug also comprises a heating filament disposed within the heater adjacent to the closed end and electrically insulated from the tubular body thereof. The heating filament has a first end electrically connected to the closed end of the heater and a second end; it is one which heats to a predetermined design temperature when a specified voltage is applied thereto. The glow plug also comprises an insulator carried by the shell, and a terminal assembly carried by the insulator. The terminal assembly comprises a heater terminal which is electrically connected to the second end of the heating filament, and at least one preheat terminal which is electrically connected to an intermediate coil of the heating filament. The rise in temperature of the heater is accelerated when a switching circuit enables application of the specified voltage to the preheat terminal(s) for a preheat time period equal to the time required to raise the temperature of the filament from ambient temperature to the design temperature.

2 Claims, 1 Drawing Figure

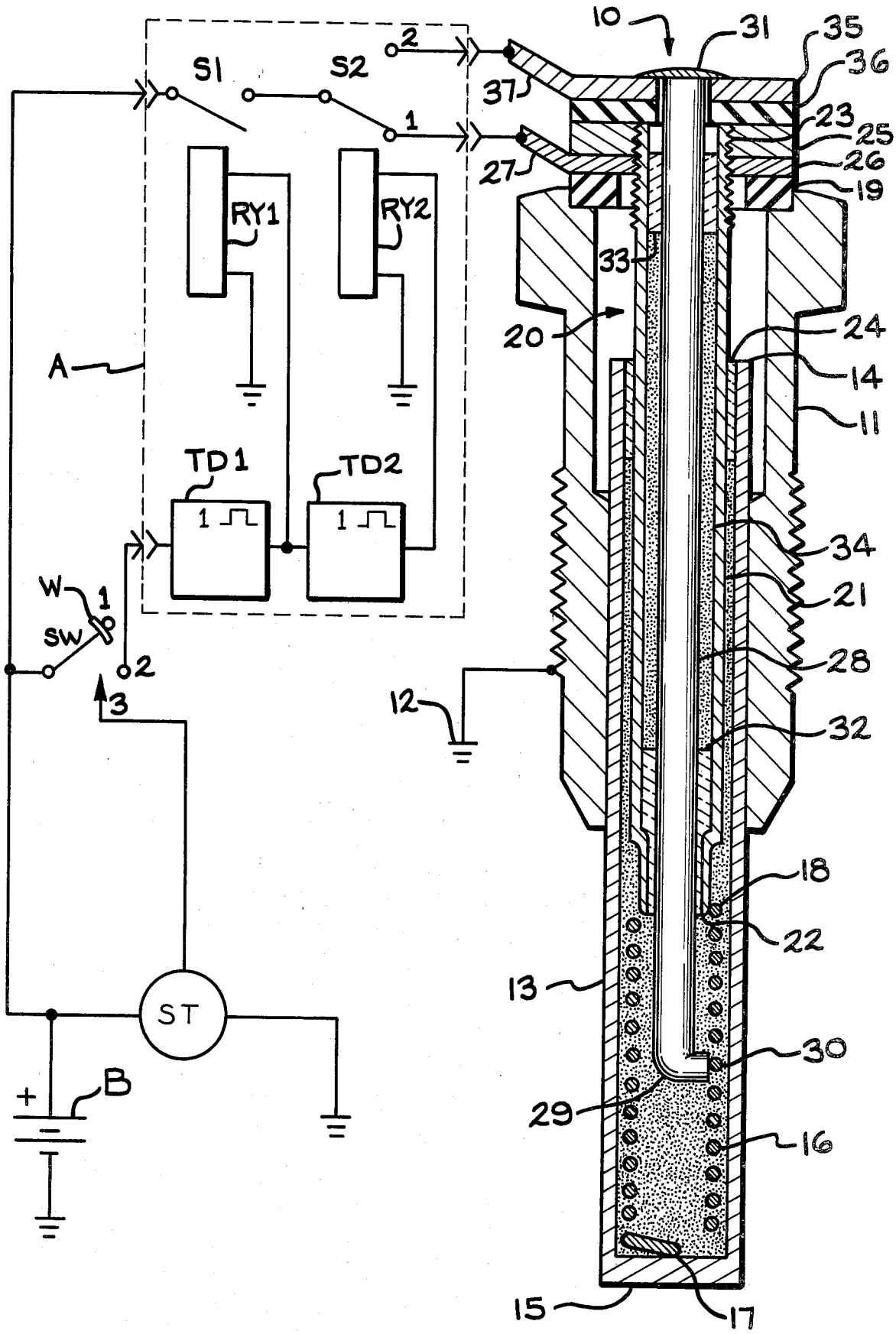
S1
S2
2
1
RY1
RY2
A
TD1
TD2
1
1
W
1
SW
2
3
ST
B
+
10
31
35
36
37
23
25
26
27
19
33
20
24
14
11
34
21
28
12
32
18
22
13
30
29
16
15
17

GLOW PLUG

BACKGROUND OF THE INVENTION

1. Field of the Invention

This invention relates to a glow plug for accelerating the ignition of fuel in a combustion chamber in a diesel engine.

2. Description of the Prior Art

A glow plug comprises a heater which projects into the combustion chamber of the engine. A filament disposed within the element is heated when the supply voltage from a power source is applied to the filament. The power source can be, for example, a conventional vehicle battery which is also used to energize a starter for the engine. The glow plug facilitates diesel engine starting by raising the temperature of the heater from ambient temperature to a temperature sufficiently high to create a hot spot in the combustion chamber to ignite incoming fuel. Therefore, an operator of the engine must wait a relatively substantial period of time, i.e., a preheat time period, before the glow plugs in the engine have been sufficiently heated to facilitate diesel engine starting. Because the battery is a source of power for the starter and other equipment as well as the filament, the voltage level of the battery fluctuates. A decreasing battery voltage further lengthens the preheat time period.

BRIEF DESCRIPTION OF THE INVENTION

The instant invention is based on the discovery of a glow plug for accelerating the ignition of fuel in a combustion chamber of a diesel engine. The glow plug comprises a shell releasably engagable with a head of the combustion chamber of the diesel engine, and an electrically conducting, tubular heater carried by and electrically connected to the shell. The element has an open end within the shell, and an opposed closed end extending longitudinally therefrom. The glow plug also comprises a heating filament disposed within the heater adjacent to the closed end thereof. The heating filament has a first end electrically connected to the closed end of the heater and a second end, and one which heats to a predetermined design temperature when a specified voltage is applied thereto. The glow plug also comprises an insulator carried by the shell and a terminal assembly carried by the insulator.

The terminal assembly comprises a heater terminal which is electrically connected to the second end of the heating filament, and at least one preheat terminal which is electrically connected to an intermediate coil of the filament. The rise in temperature of the heater is accelerated when a switching circuit enables application of the voltage to the preheat terminal(s) for a drastically reduced preheat time period equal to the time required to raise the temperature of the filament from ambient temperature to the design temperature.

OBJECTS OF THE INVENTION

It is an object of the invention to provide a glow plug for accelerating the ignition of fuel in a combustion chamber of a diesel engine.

It is a further object of the invention to provide a glow plug for accelerating the ignition of fuel in a combustion chamber of a diesel engine and to minimize the period of time an operator of the engine must wait before the glow plug has been sufficiently heated.

BRIEF DESCRIPTION OF THE DRAWING

The single drawing is a partially schematic, vertical sectional view of a glow plug in accordance with the invention and a schematic circuit diagram of a switching circuit for applying power thereto.

DETAILED DESCRIPTION OF THE INVENTION

Referring now in more detail to the Drawing, a glow plug indicated generally at 10 comprises a shell 11 threadably engagable with the head of a combustion chamber of a diesel engine (not shown). The shell 11 is electrically grounded through the head of the combustion chamber as schematically indicated at 12. The glow plug also comprises an electrically conducting, tubular heater 13 carried by and electrically connected to the shell 11. The heater 13 has an open end 14 within the shell 11, and an opposed closed end 15 extending longitudinally from the shell 11. The glow plug 10 further comprises a helical heating filament 16 disposed within the heater 13 and electrically and thermally insulated therefrom by a compacted, powdered material such as magnesium oxide. The heating filament 16 has a first end 17 adjacent, and electrically connected to, the closed end 15 of the heater 13 and a second end 18. The glow plug 10 finally comprises a resilient gasket 19 insulating the shell 11 from a terminal assembly indicated generally at 20.

The terminal assembly 20 includes a tubular electrode 21 having a lower portion which extends longitudinally within the heater 13 to a reduced diameter end 22, and an upper portion which extends axially beyond the insulator 19 to a threaded end 23. The electrode 21 is secured within the heating element 13 by a nonconducting gas seal 24 and is electrically and thermally insulated from the heater 13 by a body of powdered material such as magnesium oxide. The end 22 of the tubular electrode 21 is adjacent, and electrically connected to, the second end 18 of the heating filament 16. The threaded end 23 of the tubular electrode 21 engages an annular fastener 25 which secures an annular conductor 26 against the gasket 19. The conductor 26 has a heater terminal 27 extending radially there-from and is electrically connected through the tubular electrode 21 to the second end 18 of the heating filament 16. The first end 17 of the filament 16 is electrically connected to the heater 13 which through the shell 11 is grounded at 12. Hence, the electrical path from the heater terminal 27 to ground at 12 defines a heater circuit.

The terminal assembly 20 also includes a preheat electrode 28 which extends from a first end 29 in electrical contact with an intermediate coil 30 of the heating filament 16, through the body of the tubular electrode 21, to a second opposite end 31. Except for the connection of the swaged end 29, the preheat electrode 28 is electrically and thermally insulated from the filament 16 by a compacted, powdered material such as magnesium oxide. The preheat electrode 28 is secured within the tubular electrode 21, at the ends 22 and 23 thereof, by nonconducting seals 32 and 33, respectively. The electrode 28 is also electrically and thermally insulated from the tubular electrode 21 between the seals 32 and 33 by a body 34 of an insulating material such as magnesium oxide. The end 31 of the preheat electrode 28 secures an annular conductor 35 against an insulating washer 36 which electrically isolates the conductor 35 from the fastener 25 and from the threaded end 23 of the tubular electrode 21. The conductor 35 has a preheat terminal 37 extending radially therefrom and is electrically connected through the electrode 28 to the intermediate coil 30 of the heating filament 16. Hence, the electrical path from the preheat terminal 37 to ground at 12 defines a preheat circuit.

The filament 16 is one which heats from ambient temperature to a predetermined design temperature of, e.g., 1600 degrees Fahrenheit after a predetermined period of time, when a specified voltage of, e.g., twelve volts is applied thereto. The glow plug 10 is energized by a power source B which is a conventional vehicle battery having a voltage rating equal to the specified voltage of the filament 16. Initially, current from the power source B is applied to the preheat circuit of the glow plug 10 at the preheat terminal 37 to energize only a lower portion of the filament 16 between the intermediate coil 30 and the first end 17 thereof. The amount of current drawn from the power source B by the lower portion of the filament 16 is greater than that drawn by the full length because the specified voltage is applied to a smaller resistance; the resistance of the lower portion is but a fraction of the resistance of the full length of the filament 16. Therefore, when current is applied to the preheat terminal 37, the increased current flow through the lower portion of the filament 16 causes the temperature of the heater 13 to rise more rapidly from ambient temperature to the design temperature. This rapid heating accelerates the ignition of fuel in the combustion chamber of the engine, thus drastically reducing the preheat time period. However, since the increased current flow would eventually cause the lower portion of the filament 16 to overheat and burn out, application of current to the preheat terminal 37 is disabled when the design temperature is attained. Current from the power source B is then applied to the heater circuit of the glow plug 10 at the heater terminal 27 to energize the full length of the filament 16, thereby maintaining the design temperature.

Alternate application of the supply voltage from the preheat circuit to the heater circuit can be accomplished by any one of the various control circuits presently available. For example, the supply voltage can be controlled by a switching circuit comprising the arrangement of electronic components shown within the dashed line A of the drawing. The switching circuit A includes a power relay RY1 which when energized closes a normally-open power switch S1, and a control relay RY2 which when energized actuates a transfer switch S2 from a terminal 1 to a terminal 2. The switching circuit A also includes a power time-delay circuit TD1 which energizes the power relay RY1 and a control time-delay circuit TD2 which energizes the control relay RY2. The time-delay circuits TD1* and TD2* can be any of various electronic devices presently available, the output of which will assume its indicated 1-state when the input changes from its 0-state to its indicated 1-state. The output will remain in its indicated 1-state for a period of time which is characteristic of that particular device and is independent of the input signal.

*See ANSI Y32.14-1973, Graphic Symbols for Logic Diagrams, pg. 34, no. 4.1.

The positive terminal of the battery B is connected in series with the open power switch S1 and the transfer switch S2 through the terminal 1 to the heater circuit of the glow plug 10 at the heater terminal 27. The positive terminal is also connected to a starter ST for the diesel engine and a movable wiper contact W of an ignition switch SW which is accessible to an operator of the engine. The movable wiper contact W is operable in an OFF position 1 to prevent application of the battery voltage to the switching circuit A, operable in a PREHEAT position 2 to apply the battery voltage to the input of the power timedelay circuit TD1, and operable in a START position 3 to maintain the condition of position 2 and to apply the battery voltage to the starter ST for the engine. The ignition switch SW is operable, when turned to the START position 3 and released, to return the movable wiper contact W to the PREHEAT position 2.

When the movable wiper contact W of the ignition switch SW is turned from the OFF position 1 to the PREHEAT position 2, current from the battery B flows to the power time-delay circuit TD1 which assumes its indicated 1-state and energizes the power relay RY1 to close the open power switch S1. The power time-delay circuit TD1 also causes the control time-delay circuit TD2 to assume its indicated 1-state which energizes the control relay RY2 to actuate the transfer switch S2. Activating the transfer switch S2 completes a series connection from the battery B through the closed power switch S1, the actuated transfer switch S2, and terminal 2 thereof to the preheat circuit of the glow plug 10 at the preheat terminal 37. The control time delay circuit TD2 remains in its indicated 1-state for a period of time equal to that of the preheat time period during which the filament 16 heats rapidly to the design temperature, whereupon the control circuit TD2 returns to its 0-state.

When the control time-delay circuit TD2 returns to its 0-state, it deenergizes the control relay RY2 enabling the transfer switch S2 to return to the terminal 1. Hence, the transfer switch S2 completes a series connection from the battery B through the closed power switch S1 to the heater circuit of the glow plug 10 at the heater terminal 27 to maintain the design temperature of the filament 16. The power time-delay circuit TD1 remains in its indicated 1-state for a time period sufficient for the operator to energize the starter ST by turning the movable wiper contact W of the ignition switch SW from the PREHEAT position 2 to the START position 3. When the power time-delay circuit TD1 returns to its 0-state, it deenergizes the power relay RY1 enabling the power switch S1 to return to its normally-open position, thereby returning the glow plug 10 to a deenergized state.

It will be apparent that various changes may be made in details of construction from those shown in the attached drawing and discussed in conjunction therewith without departing from the spirit and scope of this invention as defined in the appended claims. It is, therefore, to be understood that this invention is not to be limited to the specific details shown and described.

What I claim is:

1. A glow plug comprising a shell releasibly engageable with a diesel engine, an electrically conducting heater carried by said shell, said heater having a metallic tubular body with an open end within and electrically connected to said shell and an opposed closed end extending longitudinally from said shell, an open coiled heating filament disposed within said tubular body adjacent said closed end and electrically insulated from said tubular body, said heating filament having a first end electrically connected to said closed end of said tubular body and having a second end, said filament heating to a predetermined design temperature when a predetermined voltage is applied thereto, an insulator carried by said shell, and a terminal assembly carried by said insulator, said terminal assembly having a heater terminal, a heater-connecting means electrically connecting said heater terminal to said second end of said heating filament, a preheat terminal, and preheat-connecting means electrically connecting said preheat terminal to a coil of said heating filament intermediate to said first and second ends.

2. A glow plug as claimed in claim 1 wherein said heater-connecting means comprises a tubular electrode extending longitudinally within said tubular body and electrically and thermally insulated therefrom, and said preheat-connecting means comprises a wire extending longitudinally through said tubular electrode and electrically and thermally insulated therefrom.

* * * * *